US008803925B2

(12) United States Patent
Seo et al.

(10) Patent No.: US 8,803,925 B2
(45) Date of Patent: Aug. 12, 2014

(54) LIQUID CRYSTAL DISPLAY AND SCANNING BACK LIGHT DRIVING METHOD THEREOF

(75) Inventors: Bogun Seo, Gyeonggi-do (KR); Kiduk Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 94 days.

(21) Appl. No.: 13/242,126

(22) Filed: Sep. 23, 2011

(65) Prior Publication Data

US 2012/0147062 A1 Jun. 14, 2012

(30) Foreign Application Priority Data

Dec. 8, 2010 (KR) ..... 10-2010-0124890

(51) Int. Cl.
*G09G 5/10* (2006.01)
*G09G 3/34* (2006.01)

(52) U.S. Cl.
CPC ..... *G09G 3/342* (2013.01); *G09G 2320/064* (2013.01); *G09G 2310/0229* (2013.01)
USPC ..... 345/690; 345/102; 345/204

(58) Field of Classification Search
CPC ..... G09G 2310/0229; G09G 2320/064; G09G 3/342
USPC ..... 345/102, 204, 690
See application file for complete search history.

(56) References Cited

U.S. PATENT DOCUMENTS 7,218,307 B1 * 5/2007 Chao ..... 345/102
7,321,350 B2 * 1/2008 Lee et al. ..... 345/89
7,321,351 B2 * 1/2008 Cheon ..... 345/89
7,330,170 B2 * 2/2008 Hwang ..... 345/98
2003/0020677 A1 * 1/2003 Nakano ..... 345/87
2006/0238486 A1 * 10/2006 Hiraki ..... 345/102
2008/0042953 A1 * 2/2008 De Haan et al. ..... 345/89
2008/0042968 A1 * 2/2008 Oh ..... 345/102
2008/0055232 A1 * 3/2008 Song et al. ..... 345/102
2008/0204161 A1 * 8/2008 Makita et al. ..... 332/109
2008/0252243 A1 * 10/2008 Azuma ..... 318/400.17
2009/0213098 A1 * 8/2009 Du et al. ..... 345/204
2010/0052575 A1 * 3/2010 Feng et al. ..... 315/308
2010/0213910 A1 * 8/2010 Chen ..... 323/282
2011/0084987 A1 * 4/2011 Kim et al. ..... 345/690
2011/0096101 A1 * 4/2011 Lee et al. ..... 345/690
2011/0141002 A1 * 6/2011 Kim ..... 345/102
2011/0157260 A1 * 6/2011 Pyun et al. ..... 345/691
2011/0267375 A1 * 11/2011 Yang et al. ..... 345/690
2012/0147062 A1 * 6/2012 Seo et al. ..... 345/690
2012/0147291 A1 * 6/2012 Seo ..... 349/62

* cited by examiner

*Primary Examiner* — Quan-Zhen Wang
*Assistant Examiner* — Chun-Nan Lin
(74) *Attorney, Agent, or Firm* — Morgan, Lewis & Bockius LLP

(57) ABSTRACT

A liquid crystal display includes a scanning backlight controller, that calculates a turn-on duty ratio of a pulse width modulation (PWM) signal for controlling turn-on and turn-off operations of light sources, and a light source driver, that synchronizes a frequency of the PWM signal with a frame frequency or synchronizes the frequency of the PWM signal with the frame frequency, changes the calculated turn-on duty ratio of the PWM signal to a maximum value, and adjusts an amplitude of the PWM signal based on a changed degree of the turn-on duty ratio of the PWM signal, based on the result of a comparison between the turn-on duty ratio of the PWM signal and a previously determined critical value, and then sequentially drive the light sources along a data scanning direction of the liquid crystal display panel.

14 Claims, 7 Drawing Sheets

LIQUID CRYSTAL DISPLAY AND SCANNING BACK LIGHT DRIVING METHOD THEREOF

This application claims the benefit of Korean Patent Application No. 10-2010-0124890 filed on Dec. 8, 2010, which is incorporated herein by reference for all purposes as if fully set forth herein.

BACKGROUND OF THE INVENTION

1. Field of the Invention

Embodiments of the invention relate to a liquid crystal display and a scanning backlight driving method of the liquid crystal display.

2. Discussion of the Related Art

A range of application for liquid crystal displays has gradually widened because of its excellent characteristics such as light weight, thin profile, and low power consumption. The liquid crystal displays have been used in personal computers such as notebook PCs, office automation equipments, audio/video equipments, interior/outdoor advertising display devices, and the like. A backlit liquid crystal display occupying most of the liquid crystal displays controls an electric field applied to a liquid crystal layer and modulates light coming from a backlight unit, thereby displaying an image.

When a liquid crystal display displays a motion picture, a motion blur resulting in an unclear and blurry screen may appear because of the characteristics of liquid crystals. The motion blur may remarkably appear in the motion picture, and a motion picture response time (MPRT) has to be reduced so as to remove the motion blur. A related art scanning backlight driving technology was proposed so as to reduce the MPRT. As shown in FIG. 1, the scanning backlight driving technology provides an effect similar to an impulsive drive of a cathode ray tube by sequentially turning on and off a plurality of light sources Lamp 1 to Lamp n of a backlight unit along a scanning direction of display lines of a liquid crystal display panel, thereby solving the motion blur of the liquid crystal display.

However, the related art scanning backlight driving technology was applied to only the LCD models with 120 Hz or more and was not applied to the 60 Hz LCD models. This is because a user easily perceived 60 Hz flicker when the related art scanning backlight driving technology was applied to the 60 Hz LCD model as shown in FIG. 2.

Further, because the related art scanning backlight driving technology turns off the light sources of the backlight unit for a predetermined time in each frame period, the screen becomes dark. As a solution thereto, a method for controlling the turn-off time of the light sources depending on the brightness of the screen may be considered. However, in this instance, the improvement effect of the motion blur of the related art scanning backlight driving technology is reduced because the turn-off time is shortened or omitted in the bright screen.

SUMMARY OF THE INVENTION

Embodiments of the invention provide a liquid crystal display and a scanning backlight driving method thereof capable of minimizing the perceivedness of a flicker and applying a scanning backlight driving technology to 60 Hz LCD model.

Embodiments of the invention also provide a liquid crystal display and a scanning backlight driving method thereof capable of reducing a motion blur and preventing a luminance reduction of the screen.

In one aspect, there is a liquid crystal display comprising a liquid crystal display panel configured to display modulated data based on a frame frequency, light sources configured to generate light to be irradiated into the liquid crystal display panel, a scanning backlight controller configured to calculate a turn-on duty ratio of a pulse width modulation (PWM) signal for controlling turn-on and turn-off operations of the light sources, and a light source driver configured to synchronize a frequency of the PWM signal with the frame frequency or synchronize the frequency of the PWM signal with the frame frequency, change the calculated turn-on duty ratio of the PWM signal to a maximum value, and adjust an amplitude of the PWM signal based on a changed degree of the turn-on duty ratio of the PWM signal, based on the result of a comparison between the turn-on duty ratio of the PWM signal and a previously determined critical value, and then sequentially drive the light sources along a data scanning direction of the liquid crystal display panel.

The frame frequency is selected as 60 Hz.

The light source driver includes a duty ratio deciding unit configured to compare the turn-on duty ratio of the PWM signal with the previously determined critical value and decides whether or not the turn-on duty ratio of the PWM signal is less than the previously determined critical value, a first adjusting unit configured to synchronize the frequency of the PWM signal with 60 Hz when the turn-on duty ratio of the PWM signal is less than the previously determined critical value, and a second adjusting unit configured to synchronize the frequency of the PWM signal with 60 Hz when the turn-on duty ratio of the PWM signal is equal to or greater than the previously determined critical value, change the calculated turn-on duty ratio of the PWM signal to the maximum value, vary a driving current applied to the light sources based on the changed degree of the turn-on duty ratio of the PWM signal so as to represent the same luminance, and adjust the amplitude of the PWM signal.

When an external PWM signal is input from a system, the second adjusting unit additionally adjusts the amplitude of the PWM signal based on a turn-on duty ratio of the external PWM signal.

When the turn-on duty ratio of the PWM signal is less than the previously determined critical value, the light source driver adjusts turn-on timings and turn-off timings of the light sources, so that turn-on times of the light sources are adjusted to be proportional to the calculated turn-on duty ratio of the PWM signal or a previously fixed turn-on duty ratio of the PWM signal. When the turn-on duty ratio of the PWM signal is equal to or greater than the previously determined critical value, the light source driver changes the calculated turn-on duty ratio of the PWM signal to the maximum value and scanning-drives the light sources using a modulated PWM signal, whose an amplitude is finally adjusted based on the changed degree of the turn-on duty ratio of the PWM signal and the turn-on duty ratio of the external PWM signal.

The scanning backlight controller includes an input image analysis unit configured to analyze an input image and compute a frame representative value, a duty ratio calculation unit configured to calculate the turn-on duty ratio of the PWM signal based on the frame representative value, and a data modulation unit configured to stretch data of the input image based on the frame representative value, so as to compensate for a sudden change in a luminance depending on the turn-on duty ratio of the PWM signal, and generate the modulated data.

The previously determined critical value corresponds to a lowest gray level at which a flicker starts to be perceived when the light sources are driven at 60 Hz.

In another aspect, there is a scanning backlight driving method of a liquid crystal display including a liquid crystal display panel and light sources generating light to be irradiated into the liquid crystal display panel, the scanning backlight driving method comprising calculating a turn-on duty ratio of a pulse width modulation (PWM) signal for controlling turn-on and turn-off operations of the light sources, and synchronizing a frequency of the PWM signal with a frame frequency for displaying modulated data on the liquid crystal display panel or synchronizing the frequency of the PWM signal with the frame frequency, changing the calculated turn-on duty ratio of the PWM signal to a maximum value, and adjusting an amplitude of the PWM signal based on a changed degree of the turn-on duty ratio of the PWM signal, based on the result of a comparison between the turn-on duty ratio of the PWM signal and a previously determined critical value, and then sequentially driving the light sources along a data scanning direction of the liquid crystal display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail embodiments of the invention examples of which are illustrated in the accompanying drawings.

Figure 1:
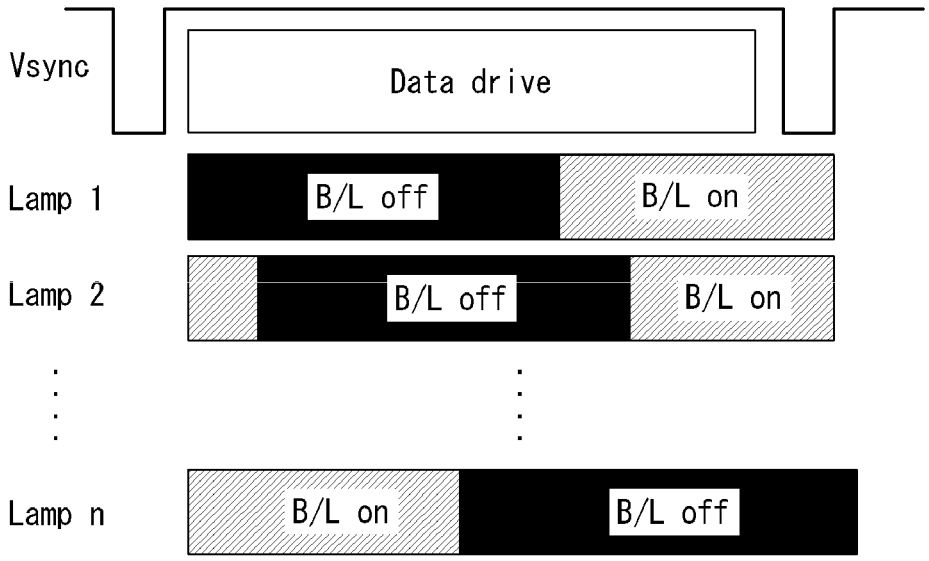
FIG. 1 (RELATED ART)
FIGS. 1 and 2 illustrate a related art scanning backlight driving technology.
Figure 2:
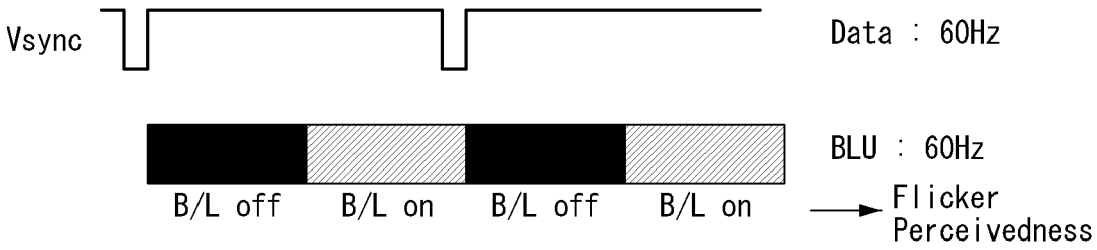
FIG. 2 (RELATED ART)
Figure 3:
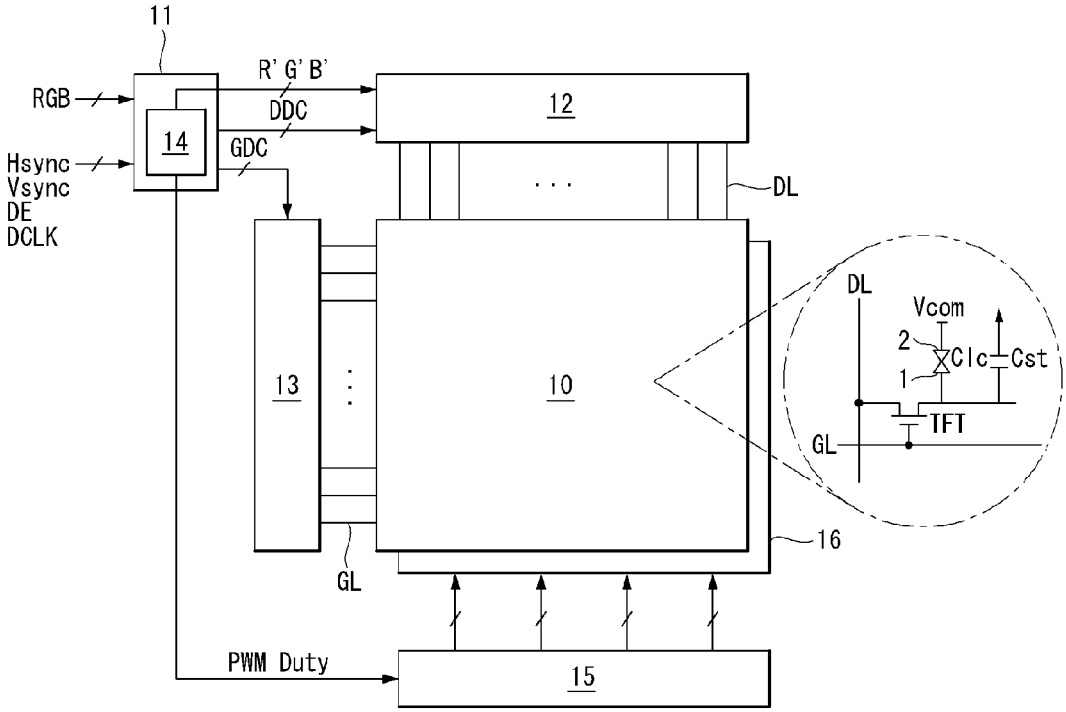
FIG. 3 illustrates a liquid crystal display according to an example embodiment of the invention.
Figure 4:
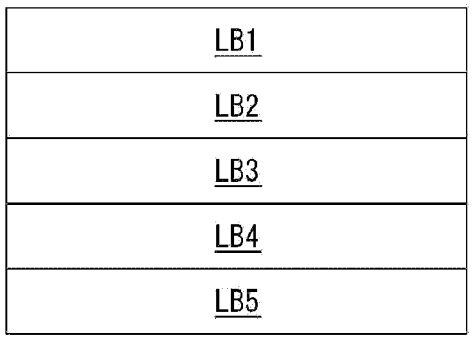
FIG. 4 illustrates light source blocks, that are sequentially driven along a data scanning direction.

FIG. 3 illustrates a liquid crystal display according to an example embodiment of the invention. FIG. 4 illustrates light source blocks, that are sequentially driven along a data scanning direction.

As shown in FIG. 3, a liquid crystal display according to an example embodiment of the invention includes a liquid crystal display panel 10, a data driver 12 for driving data lines DL of the liquid crystal display panel 10, a gate driver 13 for driving gate lines GL of the liquid crystal display panel 10, a timing controller 11 for controlling the data driver 12 and the gate driver 13, a backlight unit 16 providing light to the liquid crystal display panel 10, a scanning backlight controller 14 for controlling a sequential drive of light sources of the backlight unit 16, and a light source driver 15.

The liquid crystal display panel 10 includes an upper glass substrate, a lower glass substrate, and a liquid crystal layer between the upper and lower glass substrates. The plurality of data lines DL and the plurality of gate lines GL cross one another on the lower glass substrate of the liquid crystal display panel 10. A plurality of liquid crystal cells Clc are arranged on the liquid crystal display panel 10 in a matrix form based on a crossing structure of the data lines DL and the gate lines GL. A pixel array is formed on the lower glass substrate of the liquid crystal display panel 10. The pixel array includes the data lines DL, the gate lines GL, thin film transistors TFT, pixel electrodes of the liquid crystal cells Clc connected to the thin film transistors TFT, storage capacitors Cst, and the like.

Black matrixes, color filters, and common electrodes are formed on the upper glass substrate of the liquid crystal display panel 10. The common electrode is formed on the upper glass substrate in a vertical electric field driving manner such as a twisted nematic (TN) mode and a vertical alignment (VA) mode. The common electrode is formed on the lower glass substrate along with the pixel electrode in a horizontal electric field driving manner such as an in-plane switching (IPS) mode and a fringe field switching (FFS) mode. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

The data driver 12 includes a plurality of source integrated circuits (ICs). The data driver 12 latches modulated digital video data R'G'B' under the control of the timing controller 11 and converts the modulated digital video data R'G'B' into positive and negative analog data voltages using positive and negative gamma compensation voltages. The data driver 12 then supplies the positive/negative analog data voltages to the data lines DL.

The gate driver 13 includes a plurality of gate ICs. The gate driver 13 includes a shift register, a level shifter for converting an output signal of the shift register into a signal having a swing width suitable for a TFT drive of the liquid crystal cells, an output buffer, and the like. The gate driver 13 sequentially outputs a gate pulse (or a scan pulse) having a width of about one horizontal period and supplies the gate pulse to the gate lines GL. The shift register of the gate driver 13 may be directly formed on the lower glass substrate of the liquid crystal display panel 10 through a gate-in-panel (GIP) process.

The timing controller 11 receives digital video data RGB of an input image and timing signals Vsync, Hsync, DE, and DCLK from an external system board (not shown). The timing signals Vsync, Hsync, DE, and DCLK include a vertical sync signal Vsync, a horizontal sync signal Hsync, a data enable DE, and a dot clock DCLK. The timing controller 11 generates a data timing control signal DDC and a gate timing control signal GDC for controlling operation timings of the data driver 12 and the gate driver 13, respectively, based on the timing signals Vsync, Hsync, DE, and DCLK received from the system board. The timing controller 11 supplies the digital video data RGB of the input image to the scanning backlight controller 14 and supplies the modulated digital video data R'G'B' modulated by the scanning backlight controller 14 to the data driver 12.

The backlight unit 16 may be implemented as one of an edge type backlight unit and a direct type backlight unit. In the edge type backlight unit, the plurality of light sources are positioned opposite the side of a light guide plate, and a plurality of optical sheets are positioned between the liquid crystal display panel 10 and the light guide plate. In the direct type backlight unit, a plurality of optical sheets and a diffusion plate are stacked under the liquid crystal display panel 10, and the plurality of light sources are positioned under the diffusion plate. The light sources may be implemented as at least one of a cold cathode fluorescent lamp (CCFL), an external electrode fluorescent lamp (EEFL), and a light emitting diode (LED). The optical sheets include at least one prism sheet and at least one diffusion sheet, thereby diffusing light coming from the light guide plate or the diffusion plate and refracting a traveling path of light at an angle substantially perpendicular to a light incident surface of the liquid crystal display panel 10. The optical sheets may include a dual brightness enhancement film (DBEF).

The scanning backlight controller 14 controls the light sources using a pulse width modulation (PWM) signal, so that the light sources are sequentially driven along a data scanning direction of the liquid crystal display panel 10 under the control of the timing controller 11. The scanning backlight controller 14 analyzes the digital video data RGB of the input image and calculates a turn-on duty ratio (hereinafter referred to as "PWM duty ratio") of the PWM signal based on the result of an analysis. The scanning backlight controller 14 modulates the digital video data RGB and supplies the modulated digital video data R'G'B' to the timing controller 11, so as to compensate for a backlight luminance, that varies depending on the PWM duty ratio, using data. As shown in FIG. 3, the scanning backlight controller 14 may be mounted inside the timing controller 11. Alternatively, the scanning backlight controller 14 may be positioned outside the timing controller 11.

As shown in FIG. 4, the light source driver 15 sequentially drives a plurality of light source blocks LB1 to LB5 each including the light sources under the control of the scanning backlight controller 14, so as to synchronize with a data scanning operation of the liquid crystal display panel 10. A turn-on time of each of the light source blocks LB1 to LB5 is determined depending on the PWM duty ratio calculated by the scanning backlight controller 14. The turn-on time of the light source blocks LB1 to LB5 lengthens as the PWM duty ratio approaches to 100%, and shortens as the PWM duty ratio decreases. The light source driver 15 adjusts the turn-on timings and the turn-off timings of the light source blocks LB1 to LB5, so that turn-on times of the light source blocks LB1 to LB5 can be determined to be proportional to the PWM duty ratio. In particular, when the PWM duty ratio is less than a previously determined critical value, the light source driver 15 synchronizes a frequency of the PWM with the frame frequency (i.e., 60 Hz) for driving the liquid crystal display panel 10 and then scanning-drives the light source blocks LB1 to LB5 using the calculated PWM duty ratio or a previously fixed PWM duty ratio. Further, when the PWM duty ratio is equal to or greater than the previously determined critical value, the light source driver 15 synchronizes the frequency of the PWM signal with the frame frequency (i.e., 60 Hz) for driving the liquid crystal display panel 10. Then, the light source driver 15 changes the calculated PWM duty ratio to a maximum value (i.e., 100%) and adjusts an amplitude of the PWM signal based on a changed degree of the PWM duty ratio so as to represent the same luminance.

Figure 5:
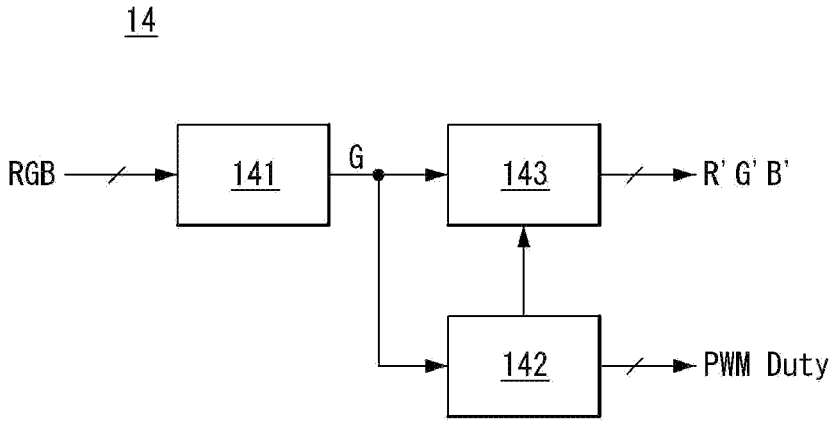
FIG. 5 illustrates in detail a scanning backlight controller.

FIG. 5 illustrates in detail the scanning backlight controller 14.

As shown in FIG. 5, the scanning backlight controller 14 includes an input image analysis unit 141, a duty ratio calculation unit 142, and a data modulation unit 143.

The input image analysis unit 141 computes a histogram (i.e., a cumulative distribution function) of the digital video data RGB of the input image and calculates a frame representative value of the histogram. The frame representative value may be calculated using a mean value and a mode value (indicating a value that occurs the most frequently in the histogram) of the histogram. The input image analysis unit 141 determines a gain value G depending on the frame representative value and supplies the gain value G to the duty ratio calculation unit 142 and the data modulation unit 143. The gain value G may increase as the frame representative value increases, and may decrease as the frame representative value decreases.

The duty ratio calculation unit 142 calculates the PWM duty ratio based on the gain value G received from the input image analysis unit 141. The PWM duty ratio is determined to be proportional to the gain value G.

The data modulation unit 143 stretches the digital video data RGB based on the gain value G received from the input image analysis unit 141 and increases a dynamic range of the modulated digital video data R'G'B' input to the liquid crystal display panel 10. The data modulation unit 143 modulates the digital video data RGB so as to compensate for a sudden change in a luminance depending on the PWM duty ratio. A data modulation operation of the data modulation unit 143 may be implemented using a look-up table.

Figure 6:
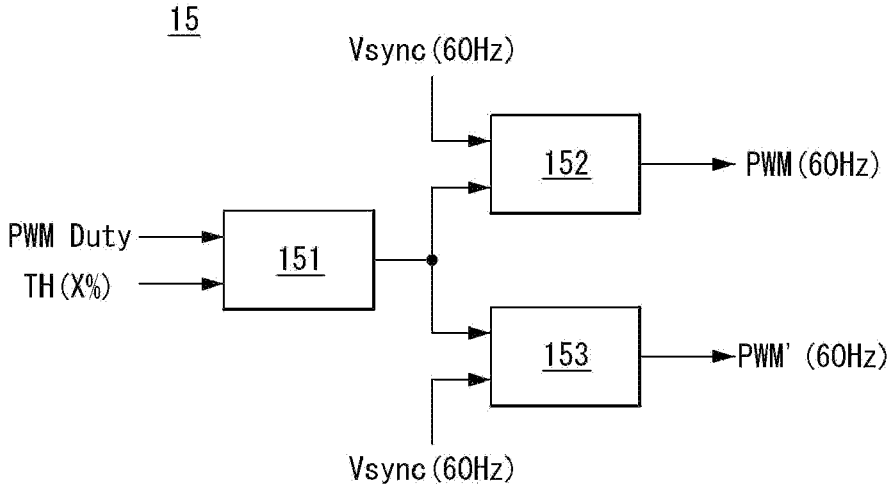
FIG. 6 illustrates in detail an example of a light source driver.
Figure 7:
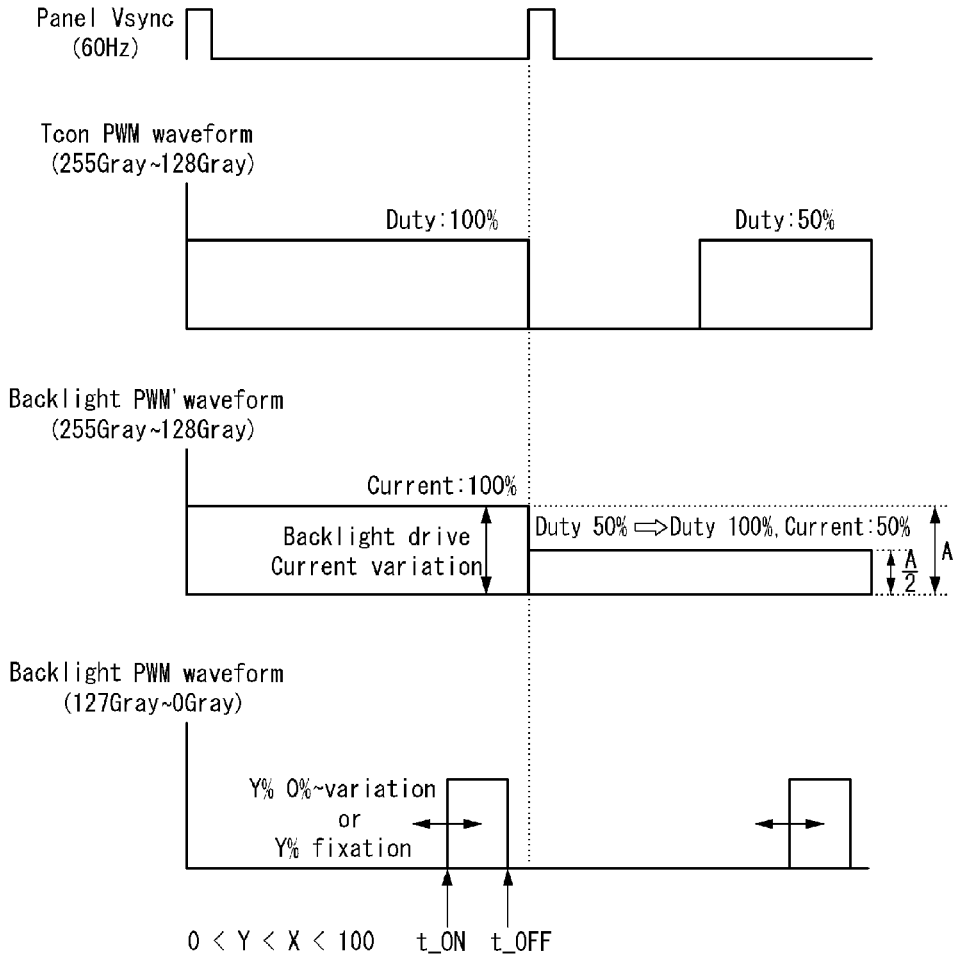
FIG. 7 illustrates an example of an amplitude of a pulse width modulation (PWM) signal adjusted by a light source driver.

FIG. 6 illustrates in detail an example of the light source driver 15. FIG. 7 illustrates an example of an amplitude of the PWM signal adjusted by the light source driver 15.

As shown in FIG. 6, the light source driver 15 includes a duty ratio deciding unit 151, a first adjusting unit 152, and a second adjusting unit 153.

The duty ratio deciding unit 151 compares the PWM duty ratio received from the scanning backlight controller 14 with a previously determined critical value TH and decides whether or not the PWM duty ratio is less than the previously determined critical value TH. The previously determined critical value TH is a PWM duty ratio (for example, X %) corresponding to the lowest gray level (for example, 128 gray level) at which a flicker starts to be perceived when the light sources are driven at 60 Hz. In this instance, the low gray level may depend on a luminance and may vary depending on the specifications of LCD models. For example, the previously determined critical value TH may be determined to about 30%.

The first adjusting unit 152 receives the decision result from the duty ratio deciding unit 151. As shown in FIG. 7, when the PWM duty ratio is less than the previously determined critical value TH, the first adjusting unit 152 decides that the frame representative value of the digital video data RGB exists between 0 gray level and 127 gray level at which the flicker is not easily perceived. Hence, the first adjusting unit 152 synchronizes the frequency of the PWM signal with the frame frequency of 60 Hz for driving the liquid crystal display panel 10. Further, the first adjusting unit 152 adjusts turn-on timings t_ON and turn-off timings t_OFF of the light source blocks LB1 to LB5, so that the turn-on times of the light source blocks LB1 to LB5 can be determined to be proportional to the PWM duty ratio of 0% to Y % (where Y<X) or a previously fixed PWM duty ratio Y %. The first adjusting unit 152 then scanning-drives the light source blocks LB1 to LB5 in conformity with the turn-on timings t_ON and the turn-off timings t_OFF.

The second adjusting unit 153 receives the decision result from the duty ratio deciding unit 151. As shown in FIG. 7, when the PWM duty ratio is equal to or greater than the critical value TH, the second adjusting unit 153 decides that the frame representative value of the digital video data RGB exists between 128 gray level and 255 gray level at which the flicker is easily perceived. Hence, the second adjusting unit 153 synchronizes the frequency of the PWM signal with the frame frequency of 60 Hz for driving the liquid crystal display panel 10. Then, the second adjusting unit 153 changes the calculated PWM duty ratio to the maximum value (i.e., 100%) and varies a driving current applied to the light source blocks LB1 to LB5 based on a changed degree of the PWM duty ratio so as to represent the same luminance, thereby adjusting the amplitude of the PWM signal. As a result, the perceivedness of the flicker is minimized For example, as shown in FIG. 7, when the PWM duty ratio is 50%, the second adjusting unit 153 changes the PWM duty ratio to 100% and reduces the driving current applied to the light source blocks LB1 to LB5 based on a changed degree of the PWM duty ratio. Hence, the amplitude of the PWM signal when the PWM duty ratio is 100% is reduced to about ½ of the amplitude of the PWM signal when the PWM duty ratio is 50%. The second adjusting unit 153 changes the PWM duty ratio to the maximum value (i.e., 100%) and scanning-drives the light source blocks LB1 to LB5 using the modulated PWM signal PWM' having the adjusted amplitude based on the changed PWM duty ratio.

Figure 8:
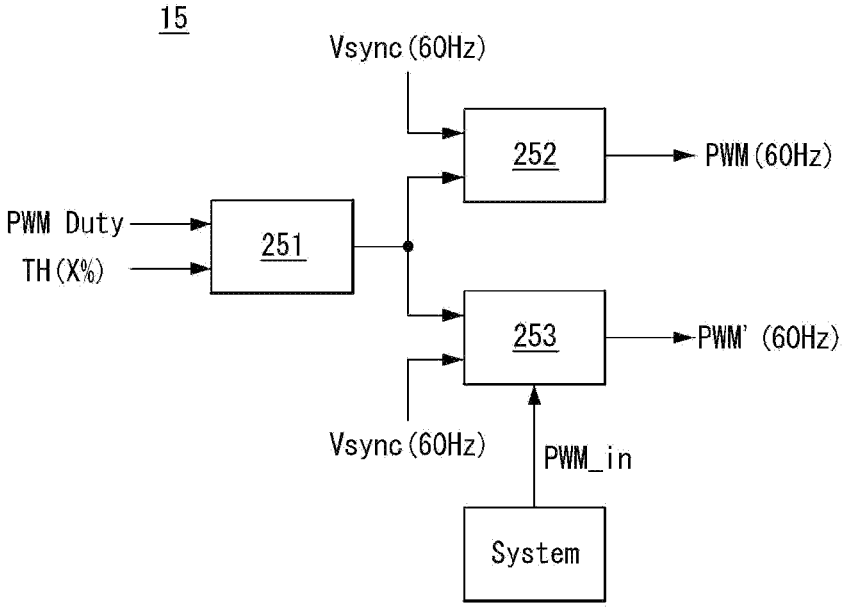
FIG. 8 illustrates in detail another example of a light source driver.
Figure 9:
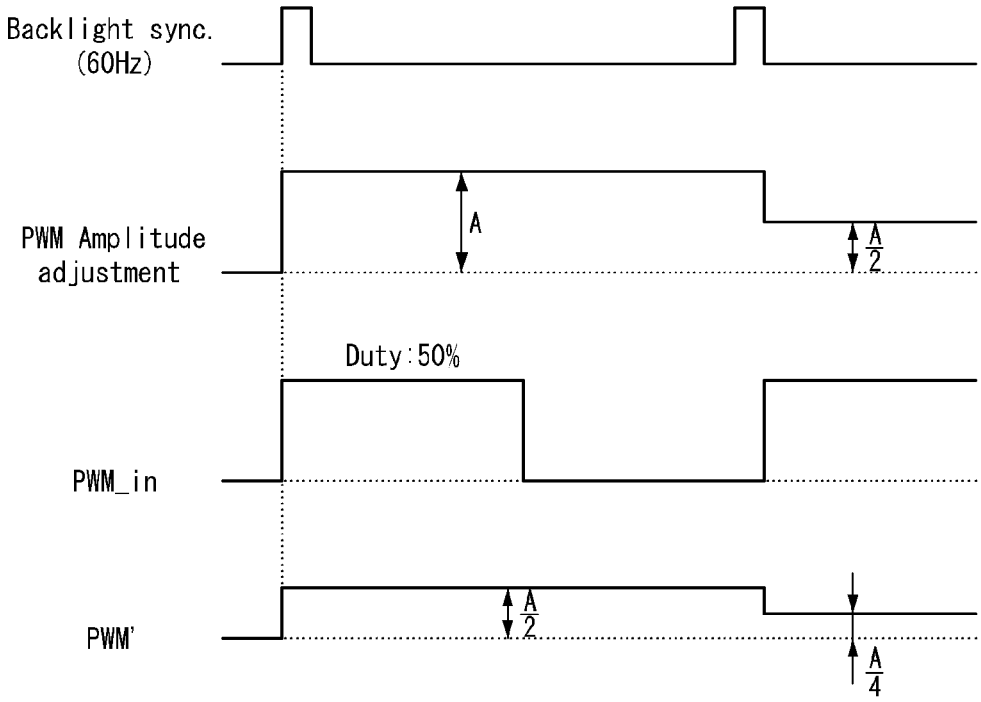
FIG. 9 illustrates another example of an amplitude of a pulse width modulation (PWM) signal adjusted by a light source driver.

FIG. 8 illustrates in detail another example of the light source driver 15. FIG. 9 illustrates another example of an amplitude of the PWM signal adjusted by the light source driver 15.

As shown in FIG. 8, the light source driver 15 includes a duty ratio deciding unit 251, a first adjusting unit 252, and a second adjusting unit 253.

The duty ratio deciding unit 251 and the first adjusting unit 252 are substantially the same as the duty ratio deciding unit 151 and the first adjusting unit 152 illustrated in the FIG. 6, respectively.

The second adjusting unit 253 receives the decision result from the duty ratio deciding unit 251. As shown in FIG. 7, when the PWM duty ratio is equal to or greater than the critical value TH, the second adjusting unit 253 decides that the frame representative value of the digital video data RGB exists between 128 gray level and 255 gray level at which the flicker is easily perceived. Hence, the second adjusting unit 253 synchronizes the frequency of the PWM signal with the frame frequency of 60 Hz for driving the liquid crystal display panel 10. Then, the second adjusting unit 253 changes the calculated PWM duty ratio to the maximum value (i.e., 100%) and varies the driving current applied to the light source blocks LB1 to LB5 based on a changed degree of the PWM duty ratio so as to represent the same luminance, thereby adjusting the amplitude of the PWM signal. As a result, the perceivedness of the flicker is minimized For example, as shown in FIG. 7, when the PWM duty ratio is 50%, the second adjusting unit 253 changes the PWM duty ratio to 100% and reduces the driving current applied to the light source blocks LB1 to LB5 based on a changed degree of the PWM duty ratio. Hence, the amplitude of the PWM signal when the PWM duty ratio is 100% is reduced to about ½ of the amplitude of the PWM signal when the PWM duty ratio is 50%.

In this state, the second adjusting unit 253 may additionally receive an external PWM signal PWM_in from a system. The system may supply the external PWM signal PWM_in selected depending on each of various image modes to the second adjusting unit 253, so that the various image modes (for example, a comfortable image mode, a clear image mode, a sport mode, and a movie mode) can be implemented depending on the user's selection. In this instance, the second adjusting unit 253 may additionally adjust the amplitude of the PWM signal based on a turn-on duty ratio of the external PWM signal PWM_in, thereby previously preventing the flicker resulting from the external PWM signal PWM_in. For example, as shown in FIG. 9, when the external PWM signal PWM_in having a turn-on duty ratio of 50% is input in a state where the amplitude of the PWM signal is adjusted based on the PWM duty ratio and is A and A/2, the second adjusting unit 253 additionally reduces the adjusted amplitudes A and A/2 of the PWM signal to ½. As a result, the amplitudes of the modulated PWM signal PWM' are A/2 and A/4. The second adjusting unit 253 changes the PWM duty ratio to the maximum value (i.e., 100%) and scanning-drives the light source blocks LB1 to LB5 using the modulated PWM signal PWM', whose the amplitude is adjusted based on the changed degree of the PWM duty ratio and the turn-on duty ratio of the external PWM signal PWM in.

Figure 10:
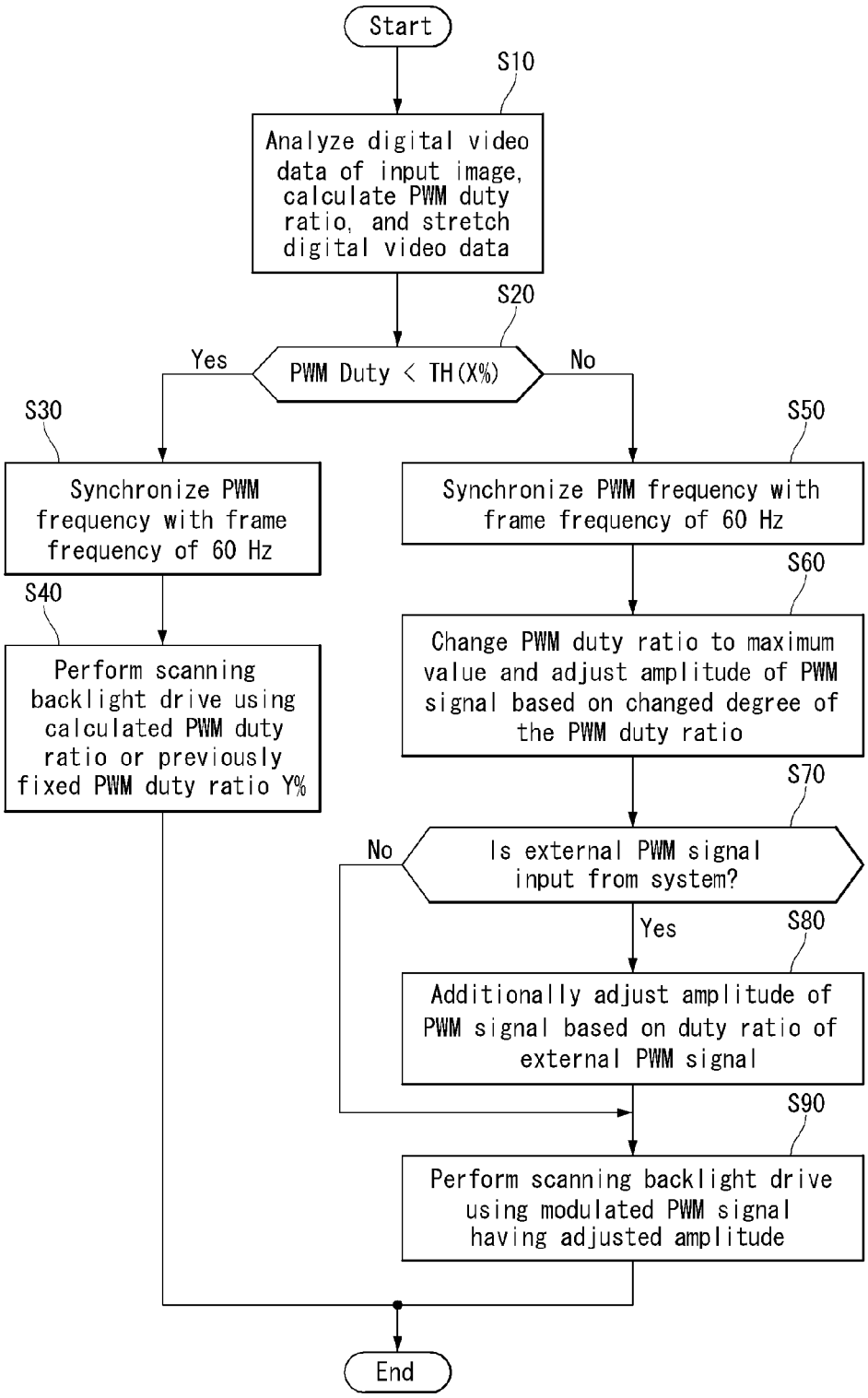
FIG. 10 sequentially illustrates a scanning backlight driving method of a liquid crystal display according to an example embodiment of the invention.

FIG. 10 sequentially illustrates a scanning backlight driving method of the liquid crystal display according to the example embodiment of the invention.

As shown in FIG. 10, the scanning backlight driving method analyzes the digital video data RGB of the input image, computes the frame representative value, calculates the PWM duty ratio based on the frame representative value, and stretches the digital video data RGB so as to compensate for a sudden change in the luminance depending on the PWM duty ratio, in step S10.

Next, the scanning backlight driving method compares the calculated PWM duty ratio with the previously determined critical value TH and decides whether or not the PWM duty ratio is less than the previously determined critical value TH in step S20. The critical value TH is a PWM duty ratio (for example, X %) corresponding to the lowest gray level (for example, 128 gray level) at which the flicker starts to be perceived when the light sources are driven at 60 Hz. In this instance, the low gray level may depend on the luminance and may vary depending on the specifications of LCD models. For example, the previously determined critical value TH may be determined to about 30%.

When the PWM duty ratio is less than the critical value TH, the scanning backlight driving method decides that the frame representative value of the digital video data RGB exists between 0 gray level and 127 gray level at which the flicker is not easily perceived, and synchronizes the frequency of the PWM signal with the frame frequency of 60 Hz for driving the liquid crystal display panel in step S30. Further, the scanning backlight driving method adjusts turn-on timings and turn-off timings of the light source blocks, so that the turn-on times of the light source blocks can be determined to be proportional to the PWM duty ratio of 0% to Y % or the previously fixed PWM duty ratio Y %, and then scanning-drives the light source blocks in conformity with the turn-on timings and the turn-off timings in step S40.

When the PWM duty ratio is equal to or greater than the critical value TH, the scanning backlight driving method decides that the frame representative value of the digital video data RGB exists between 128 gray level and 255 gray level at which the flicker is easily perceived, and synchronizes the frequency of the PWM signal with the frame frequency of 60 Hz for driving the liquid crystal display panel in step S50. Then, the scanning backlight driving method changes the calculated PWM duty ratio to the maximum value (i.e., 100%) and varies the driving current applied to the light source blocks based on a changed degree of the PWM duty ratio so as to represent the same luminance, thereby adjusting the amplitude of the PWM signal, in step S60. As a result, the perceivedness of the flicker is minimized.

Next, the scanning backlight driving method decides whether or not the external PWM signal PWM_in is input from the system in step S70.

When the external PWM signal PWM_in is input from the system, the scanning backlight driving method additionally adjusts the amplitude of the PWM signal based on the turn-on duty ratio of the external PWM signal PWM_in, thereby preventing the flicker resulting from the external PWM signal PWM_in in step S80.

Next, the scanning backlight driving method changes the PWM duty ratio to the maximum value (i.e., 100%) and scanning-drives the light source blocks using the modulated PWM signal PWM', whose the amplitude is finally adjusted based on the changed degree of the PWM duty ratio and the turn-on duty ratio of the external PWM signal PWM_in, in step S90.

As described above, the liquid crystal display and the scanning backlight driving method thereof according to the example embodiment of the invention synchronize the frequency of the PWM signal with the frame frequency of 60 Hz for driving the liquid crystal display panel because the flicker is not easily perceived at gray levels less than the lowest gray level at which the flicker starts to be perceived. Further, the example embodiment of the invention synchronizes the frequency of the PWM signal with the frame frequency of 60 Hz for driving the liquid crystal display panel at gray level equal to or greater than the lowest gray level. Then, the example embodiment of the invention changes the calculated PWM duty ratio to the maximum value (i.e., 100%) and varies the driving current applied to the light source blocks based on a changed degree of the PWM duty ratio so as to represent the same luminance, thereby adjusting the amplitude of the PWM signal. As a result, the perceivedness of the flicker is minimized. In particular, when the external PWM signal is input from the system, the example embodiment of the invention additionally adjusts the amplitude of the PWM signal based on the turn-on duty ratio of the external PWM signal, thereby previously preventing the flicker resulting from the external PWM signal.

Furthermore, the liquid crystal display and the scanning backlight driving method thereof according to the example embodiment of the invention stretch the digital video data of the input image so as to compensate for a sudden change in the luminance depending on the PWM duty ratio, thereby reducing the motion blur and efficiently preventing the luminance reduction of the screen.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display, comprising:

a liquid crystal display panel configured to display modulated data based on a frame frequency;

light sources configured to generate light to be irradiated into the liquid crystal display panel;

a scanning backlight controller configured to calculate a turn-on duty ratio of a pulse width modulation (PWM) signal for controlling turn-on and turn-off operations of the light sources; and a light source driver configured to:

compare the calculated turn-on duty ratio of the PWM signal with a critical value;

differently process the PWM signal according to a result of the comparing such that a frequency of the PWM signal is synchronized with the frame frequency;

the turn-on duty ratio of the PWM signal is changed to a value corresponding to full operation of the PWM signal;

an amplitude of the PWM signal is adjusted based on a changed degree of the turn-on duty ratio of the PWM signal; and subsequently sequentially drive the light sources along a data scanning direction of the liquid crystal display panel, wherein the scanning backlight controller comprises an input image analysis unit, a duty ratio calculation unit, and a data modulation unit, wherein the input image analysis unit is configured to:

compute a cumulative distribution function of digital video data of an input image;

calculate a frame representative value based on the cumulative distribution function, the calculation including a mean value and a mode value of the cumulative distribution function;

determine a gain value based on the frame representative value; and supply the gain value to the duty ratio calculation unit and the data modulation unit, and wherein the duty ratio calculation unit is configured to calculate the PWM duty ratio based on the gain value received from the input image analysis unit.

2. The liquid crystal display of claim 1, wherein the frame frequency is selected as 60 Hz.

3. The liquid crystal display of claim 2, wherein the light source driver includes:

a duty ratio deciding unit configured to:

compare the turn-on duty ratio of the PWM signal with the critical value; and decide whether the turn-on duty ratio of the PWM signal is less than the critical value;

a first adjusting unit configured to synchronize the frequency of the PWM signal with 60 Hz when the turn-on duty ratio of the PWM signal is less than the critical value; and a second adjusting unit configured to:

synchronize the frequency of the PWM signal with 60 Hz when the turn-on duty ratio of the PWM signal is equal to or greater than the critical value;

change the calculated turn-on duty ratio of the PWM signal to the value corresponding to full operation of the PWM signal;

vary a driving current applied to the light sources based on the changed degree of the turn-on duty ratio of the PWM signal so as to represent the same luminance; and adjust the amplitude of the PWM signal.

4. The liquid crystal display of claim 3, wherein, when an external PWM signal is input from a system, the second adjusting unit additionally adjusts the amplitude of the PWM signal based on a turn-on duty ratio of the external PWM signal.

5. The liquid crystal display of claim 4, wherein:

when the turn-on duty ratio of the PWM signal is less than the critical value, the light source driver is further configured to adjust turn-on timings and turn-off timings of the light sources, such that turn-on times of the light sources are adjusted to be proportional to the calculated turn-on duty ratio of the PWM signal or a previously fixed turn-on duty ratio of the PWM signal; and when the turn-on duty ratio of the PWM signal is equal to or greater than the critical value, the light source driver is further configured to:

change the calculated turn-on duty ratio of the PWM signal to the value corresponding to full operation of the PWM signal; and scanning-drive the light sources using a modulated PWM signal, whose an amplitude is finally adjusted based on the changed degree of the turn-on duty ratio of the PWM signal and the turn-on duty ratio of the external PWM signal.

6. The liquid crystal display of claim 2, wherein the critical value corresponds to a lowest gray level at which a flicker starts to be perceived when the light sources are driven at 60 Hz.

7. The liquid crystal display of claim 1, wherein the scanning backlight controller includes:

an input image analysis unit configured to analyze an input image and compute a frame representative value;

a duty ratio calculation unit configured to calculate the turn-on duty ratio of the PWM signal based on the frame representative value; and a data modulation unit configured to:

stretch data of the input image based on the frame representative value, to compensate for a change in a luminance depending on the turn-on duty ratio of the PWM signal; and generate the modulated data.

8. A scanning backlight driving method of a liquid crystal display including a liquid crystal display panel and light sources generating light to be irradiated into the liquid crystal display panel, the scanning backlight driving method comprising:

calculating a turn-on duty ratio of a pulse width modulation (PWM) signal for controlling turn-on and turn-off operations of the light sources;

comparing the calculated turn-on duty ratio of the PWM signal with a critical value;

synchronizing a frequency of the PWM signal with a frame frequency for displaying modulated data on the liquid crystal display panel;

changing the turn-on duty ratio of the PWM signal to a value corresponding to full operation of the PWM signal;

adjusting an amplitude of the PWM signal based on a changed degree of the turn-on duty ratio of the PWM signal, according to a result of the comparing;

subsequently sequentially driving the light sources along a data scanning direction of the liquid crystal display panel, computing a cumulative distribution function of digital video data of an input image;

calculating a frame representative value based on the cumulative distribution function, the calculation including a mean value and a mode value of the cumulative distribution function; and determining a gain value based on the frame representative value, wherein the PWM duty ratio is calculated based on the gain value.

9. The scanning backlight driving method of claim 8, wherein the frame frequency is selected as 60 Hz.

10. The scanning backlight driving method of claim 9, wherein the critical value corresponds to a lowest gray level at which a flicker starts to be perceived when the light sources are driven at 60 Hz.

11. The scanning backlight driving method of claim 8, wherein the sequential driving of the light sources includes:

when the turn-on duty ratio of the PWM signal is less than the critical value, synchronizing the frequency of the PWM signal with 60 Hz; and when the turn-on duty ratio of the PWM signal is equal to or greater than the critical value;

synchronizing the frequency of the PWM signal with 60 Hz;

changing the turn-on duty ratio of the PWM signal to the value corresponding to full operation of the PWM signal;

varying a driving current applied to the light sources based on the changed degree of the turn-on duty ratio of the PWM signal to represent the same luminance; and adjusting the amplitude of the PWM signal.

12. The scanning backlight driving method of claim 11, wherein the adjusting of the amplitude of the PWM signal includes additionally adjusting the amplitude of the PWM signal based on a turn-on duty ratio of an external PWM signal when the external PWM signal is input from a system.

13. The scanning backlight driving method of claim 12, wherein the sequentially driving of the light sources includes:

when the turn-on duty ratio of the PWM signal is less than the critical value, adjusting turn-on timings and turn-off timings of the light sources, such that turn-on times of the light sources are adjusted to be proportional to the calculated turn-on duty ratio of the PWM signal or a previously fixed turn-on duty ratio of the PWM signal; and when the turn-on duty ratio of the PWM signal is equal to or greater than the critical value;

changing the calculated turn-on duty ratio of the PWM signal to the value corresponding to full operation of the PWM signal; and scanning-driving the light sources using a modulated PWM signal, whose an amplitude is finally adjusted based on the changed degree of the turn-on duty ratio of the PWM signal and the turn-on duty ratio of the external PWM signal.

14. The scanning backlight driving method of claim 8, wherein the calculating of the turn-on duty ratio of the PWM signal further includes:

analyzing an input image to compute a frame representative value;

calculating the turn-on duty ratio of the PWM signal based on the frame representative value; and stretching data of the input image based on the frame representative value, so as to compensate for a change in a luminance depending on the turn-on duty ratio of the PWM signal, and generating the modulated data.

* * * * *